US008567381B2

(12) United States Patent
Saunders

(10) Patent No.: US 8,567,381 B2
(45) Date of Patent: Oct. 29, 2013

(54) BOWSTRING SOUND DAMPENER

(76) Inventor: Charles A. Saunders, Columbus, NE (US)

( * ) Notice: Subject to any disclaimer, the term of this patent is extended or adjusted under 35 U.S.C. 154(b) by 188 days.

(21) Appl. No.: 13/040,071

(22) Filed: Mar. 3, 2011

(65) Prior Publication Data

US 2011/0214656 A1 Sep. 8, 2011

Related U.S. Application Data

(60) Provisional application No. 61/310,124, filed on Mar. 3, 2010.

(51) Int. Cl.
*F41B 5/00* (2006.01)

(52) U.S. Cl.
USPC ..... 124/88; 124/86; 124/89; 124/90; 124/92

(58) Field of Classification Search
USPC ..... 124/86, 88, 89, 9, 92, 920
See application file for complete search history.

(56) References Cited

U.S. PATENT DOCUMENTS 5,137,318 A * 8/1992 Lohman ..... 294/100
5,452,704 A * 9/1995 Winebarger ..... 124/92
5,720,269 A * 2/1998 Saunders ..... 124/86
6,543,432 B2 4/2003 Andrews et al.
6,634,348 B2 10/2003 Gallops, Jr.
6,966,314 B2 11/2005 McPherson
7,954,481 B2 * 6/2011 Barnard ..... 124/88
2002/0152662 A1 * 10/2002 Lane et al. ..... 42/70.11
2006/0009783 A1 * 1/2006 Rome et al. ..... 606/108
2008/0264400 A1 * 10/2008 Wright ..... 124/89
2009/0000606 A1 * 1/2009 Cooper et al. ..... 124/25.6
2010/0319669 A1 * 12/2010 Grace, Jr. ..... 124/88

* cited by examiner

*Primary Examiner* — Gene Kim
*Assistant Examiner* — John E Simms, Jr.
(74) *Attorney, Agent, or Firm* — Levenfeld Pearlstein, LLC

(57) ABSTRACT

A bowstring sound dampener is disclosed. The dampener comprises a sleeve and a piston. The sleeve is generally cylindrical with a frustoconical first end adapted to threadedly receive a mounting rod for connecting the dampener to a bow. The sleeve comprises a second end which is flared outwardly with a pair of generally V-shaped grooves formed diametrically therein creating a pair of diametrically opposed arms. The sleeve is configured to matingly receive the piston therein. The piston is formed as a generally cylindrical member having a pair of grippers extending therefrom on one end with a groove formed therebetween. The grippers flare outwardly from the piston in a diametrically opposed configuration and are mounted to the piston such that the grippers move inwardly when the piston enters the sleeve, thereby grasping the bowstring, and outwardly when the piston exits the sleeve, thereby releasing the bowstring.

17 Claims, 5 Drawing Sheets

BOWSTRING SOUND DAMPENER

CROSS-REFERENCE TO RELATED APPLICATIONS

This application claims the benefit of U.S. Provisional Application No. 61/310,124 filed on Mar. 3, 2010, the contents of which are incorporated herein by reference.

BACKGROUND OF THE INVENTION

The present invention relates generally to archery bows and their components and accessories, and more particularly to an apparatus for dampening the vibration of a bowstring to silence the sound produced by the bowstring during the release of the bowstring when shooting.

As recognized by those skilled in the art, a bowstring on an archery bow will produce a characteristic noise upon release of the bowstring to launch an arrow. This characteristic noise is associated with the vibrational pattern created by the bowstring, and is colloquially referred to as a "twang."

While this sound does not affect the accuracy of a shot, the sound travels faster than the arrow and, therefore, the sound may startle the target and reduce the potential for an accurate hit. There have been numerous solutions proposed to this problem, many of them basing their effectiveness on the attachment of some device to the bow and/or the bowstring to "interfere" with the oscillating movement of the bowstring and thereby reduce the associated noise created by the bowstring.

For example, U.S. Pat. No. 5,720,269, issued to Saunders, discloses a bowstring sound dampener having a support arm with one end mounted to a bow, and a cushion member on a second end of the support. The cushion member is formed of a resilient material which absorbs the energy of movement of the bowstring upon release of the bowstring after launching an arrow, thereby dampening the sound emitted by the string.

U.S. Pat. No. 6,966,314, issued to McPherson, discloses a limb-mounted bowstring vibration and noise suppressor. The vibration and noise suppressor is carried by a support having an attachment device at one end for attaching the suppressor to a limb of a bow.

In yet another example, U.S. Pat. No. 6,543,432, issued to Andrews et al., discloses an archery bow having at least one dampener configured to reduce noise and vibration of the bow. The dampener is connected to a limb or to a riser or handle portion of the bow to reduce vibrations transferred to the riser by the limb.

While the preceding prior art devices perform well, most involve the bowstring impacting a relatively immobile surface, thereby creating additional noise created when the bowstring impacts the surface. Moreover, many prior art sound dampener devices permit the bowstring to impact the device multiple times before the bowstring is stopped, thereby lessening the effectiveness of the device.

Therefore, what is needed is a bowstring sound dampening device that offers not only an improved ability to trap the bowstring to prevent the bowstring from oscillating after the shot and creating unwanted noise, but that also reduces the noise created upon impact of the bowstring, thereby providing additional benefit. The instant invention satisfies this need.

BRIEF SUMMARY OF THE INVENTION

The present invention comprises an apparatus for dampening the vibration of a bowstring to thereby silence the sound produced during the release of a drawn bowstring.

Specifically, the bowstring sound dampener of the present invention comprises a sleeve and a piston. The sleeve is generally cylindrical in shape with a generally frustoconical first end adapted to threadedly receive a mounting rod or similar structure for connecting the bowstring sound dampener to a bow. The sleeve comprises a second end which is flared outwardly with a pair of generally V-shaped grooves formed diametrically therein creating a pair of diametrically opposed arms. The sleeve is configured to matingly receive the piston therein.

The piston is formed as a generally cylindrical member having a pair of grippers extending therefrom on one end. The grippers flare outwardly from the piston in a diametrically opposed configuration. A groove is formed at the intersection of the grippers, the groove configured to receive and retain the bowstring after the drawn bowstring is released. The grippers are flexibly or pivotally mounted to the piston such that the grippers may move inwardly, towards one another, when the piston enters the sleeve. The grippers are biased outwardly, such that the grippers move outwardly, away from one other, when the piston exits the sleeve.

These and other features and advantages of the present invention will be apparent from the following detailed description, in conjunction with the appended claims.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1:
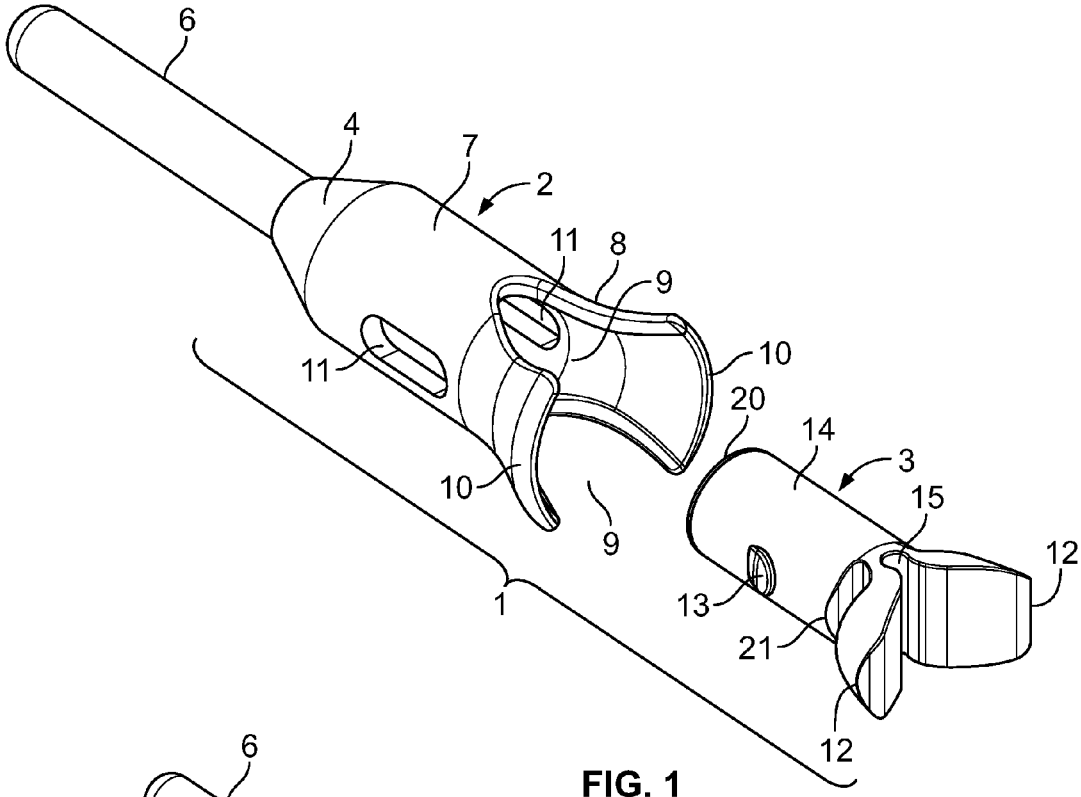
FIG. 1 is a perspective partially exploded view of a bowstring sound dampener embodying the principles of the present invention.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

It should be further understood that the title of this section of this specification, namely, "Detailed Description of the Invention," relates to a requirement of the United States Patent Office, and does not imply, nor should be inferred to limit the subject matter disclosed herein.

FIGS. 1-12 illustrate the bowstring sound dampener according to the principles of the present invention.

As shown in FIG. 1, in the preferred embodiment, the bowstring sound dampener 1 comprises a sleeve 2 and a piston 3. Sleeve 2 is comprises a hollow, a central portion 7 having a generally frustoconical first end 4 and an outwardly flared second end 8. Central portion 7 in the disclosed embodiment is generally cylindrical. In the preferred embodiment, sleeve 2 is a comprised of a rigid, lightweight material, such as aluminum, plastic or other materials known in the art. Those skilled in the art will recognize the wide variety of materials that may be used for sleeve 2.

Figure 8:
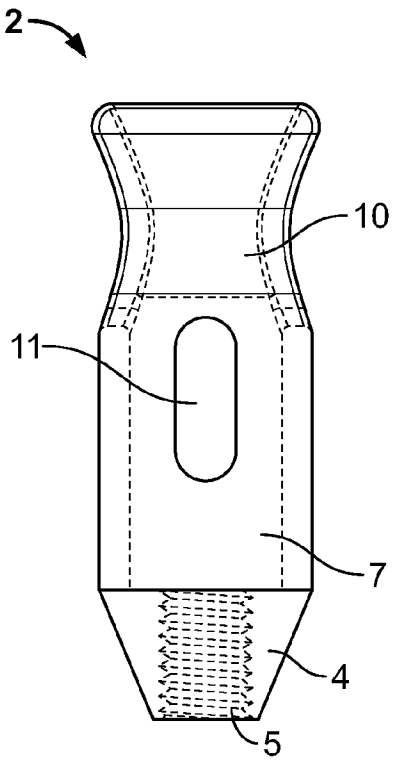
FIG. 8 is an enlarged side view of the sleeve of the bowstring sound dampener of FIG. 1.
Figure 7:
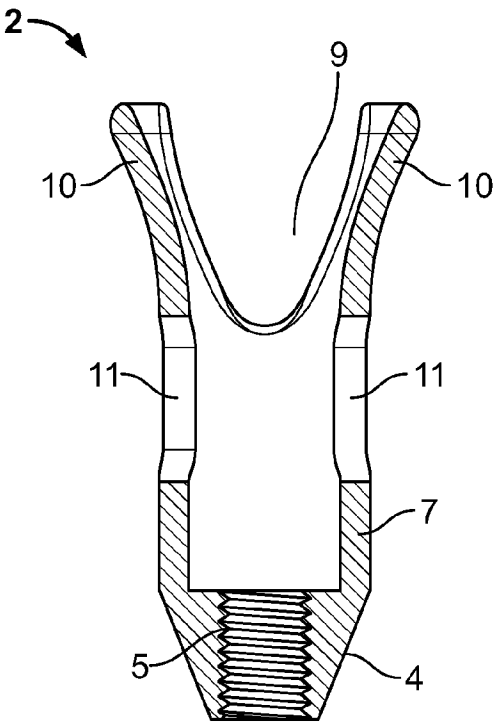
FIG. 7 is an enlarged cross-sectional side view of the sleeve of the bowstring sound dampener of FIG. 1.
Figure 6:
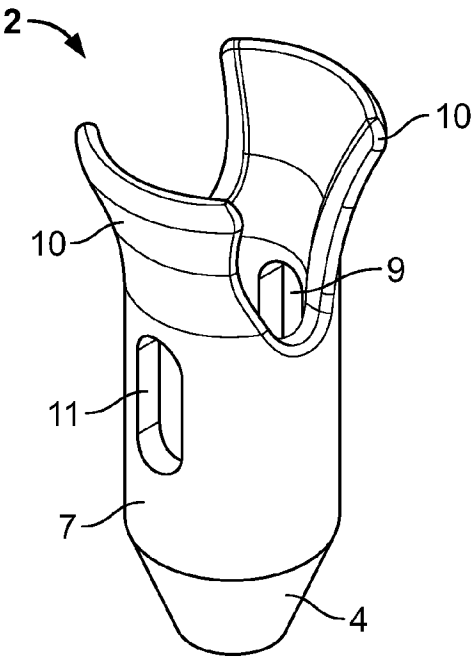
FIG. 6 is an enlarged perspective view of the sleeve of the bowstring sound dampener of FIG. 1.
Figure 12:
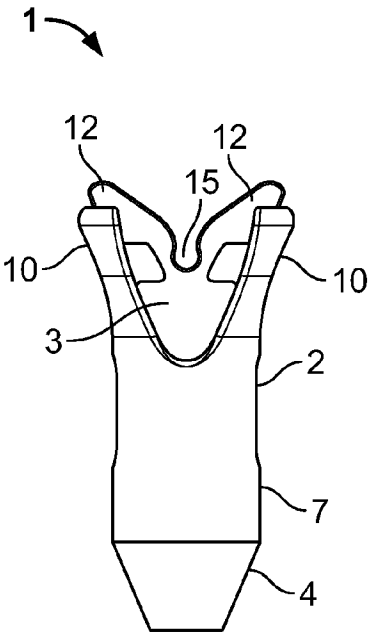
Figure 11:
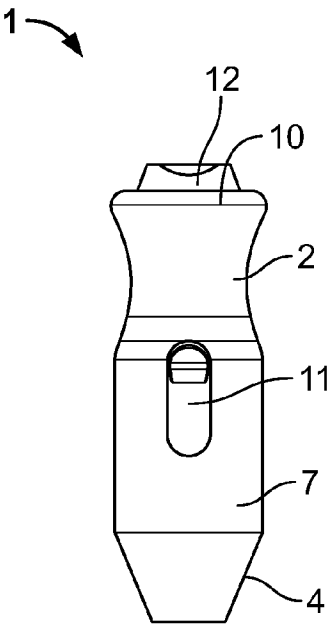
FIG. 11 is a side view of the assembled bowstring sound dampener of FIG. 1; and, FIG. 12 is a front view of the assembled bowstring sound dampener of FIG. 1.
Figure 10:
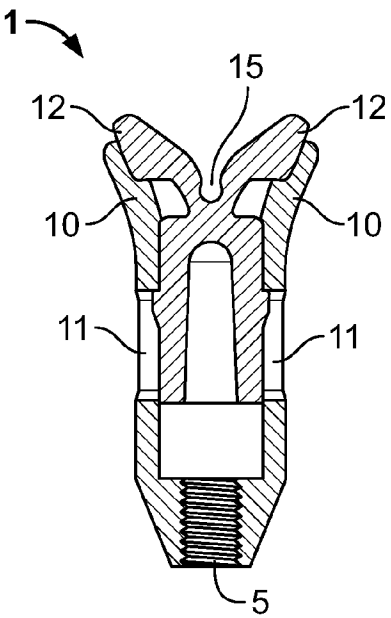
FIG. 10 is a cross-sectional front view of the assembled bowstring sound dampener of FIG. 1.
Figure 9:
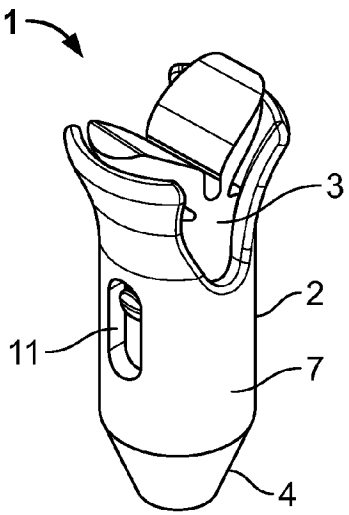
FIG. 9 is a perspective view of the assembled bowstring sound dampener of FIG. 1.

As shown in FIGS. 7, 8 and 10, first end 4 of sleeve 2 is configured with a threaded bore 5 extending therethrough and configured to matingly and threadedly receive a threaded mounting rod 6 for connecting bowstring sound dampener 1 to a bow (not shown). It will be appreciated by those skilled in the art that the connection means used to connect bowstring sound dampener 1 to a bow, and the location on the bow to which bowstring sound dampener 1 is connected, can vary.

By way of example, mounting rod 6 need not be threadedly connected to sleeve 2, but instead may be connected in any other suitable manner such that bowstring sound dampener 1 is attached to mounting rod 6, such as by friction fit or other means.

By way of further example, it also will be appreciated by those skilled in the art that bowstring sound dampener 1 of the present invention may be mounted to the bow in any suitable location, including the handle, the limbs or in other locations or manners such that bowstring sound dampener 1 lies in the path of the bowstring after the drawn bowstring is released. This may include movable attachment means whereby bow string sound dampener 1 is initially disposed outside of the path of the bowstring before the drawn bowstring is released, but is moved into the path of the bowstring after the drawn bowstring is released. Additionally, mounting rod 6 may be permanently or removably affixed to the bow.

In the preferred embodiment, outwardly flared second end 8 of sleeve 2 is formed with a pair of diametrically opposed generally V-shaped grooves 9 extending from outwardly flared second end 8 towards central portion 7, as shown in FIGS. 1, 6, 7 and 8. V-shaped grooves 9 are configured to permit the bowstring to enter and/or pass through outwardly flared second end 8 after the drawn bowstring is released, as further discussed and described below. It will be appreciated by those skilled in the art that while V-shaped grooves 9 in the disclosed embodiment have a general V-shape, grooves 9 may be more rounded (such as a U-shape or a C-shape) without departing from the scope of the present disclosure.

V-shaped grooves 9 form a pair of diametrically opposed arms 10 at outwardly flared second end 8, the distance between arms 10 decreasing such that the distance between arms 10 is greater closer to outwardly flared end 8 than the distance between arms 10 closer to central portion 7. In this manner, arms 10 are configured to receive piston 3 and cause grippers 12 of piston 3 to contract inwardly around the bowstring after the drawn bowstring is released, as further discussed and described below.

In the disclosed embodiment, central portion 7 of sleeve 2 further comprises a pair of diametrically opposed slots 11 formed therein. Slots 11 are configured to matingly engage a pair of diametrically opposed studs 13 formed on piston 3 in order to guide piston 3 within sleeve 2 and to limit the movement of piston 3 within sleeve 2.

It will be appreciated by those skilled in the art that in some embodiments of bowstring sound dampener 1 of the present invention, slots 11 and studs 13 may be omitted, supplemented by and/or replaced with other mechanisms and means to control and limit the movement of piston 3 within sleeve 2. This can be accomplished for example, through use of a set screw extending through sleeve 2 and configured to interfere with the movement of piston 3 through sleeve 2. In another embodiment, bowstring sound dampener 1 may be provided with a cushion member (or bottoming pad), not shown, as further discussed below. In yet another embodiment, the materials of sleeve 2 and/or piston 3 may be adjusted to create a desired degree of friction between sleeve 2 and piston 3 in order to control and/or limit the movement of piston 3 within sleeve 2.

Those skilled in the art also will recognize that it is possible to alter the size, shape material and/or geometry of piston 3 such that its movement through sleeve 2 is controlled in a desirable manner, such as, for example, to "tune" bowstring sound dampener 1 to reduce or eliminate "escape cycles" created when the bowstring bounces out (or escapes) from between grippers 12 before being fully gripped by grippers 12. All such embodiments of bowstring sound dampener 1 are included within the scope of the instant disclosure.

As shown in FIGS. 1, 3, 4 and 5, piston 3 is formed as a generally cylindrical member having a diameter slightly less than the inner diameter of central portion 7 of sleeve 2, such that piston 3 may slidably move within sleeve 2, preferably with only a slight degree of frictional engagement between piston 3 and sleeve 2. Those skilled in the art will recognize, however, that the degree of frictional engagement between piston 3 and sleeve 2 can vary from no to slight frictional engagement, to a high degree of frictional engagement, as may be desired to tune bowstring sound dampener 1 to reduce or eliminate escape cycles. All such variations in frictional engagement are included within the scope of the instant disclosure.

Piston 3 preferably is formed of a resilient material capable of holding its shape, but also capable of absorbing the force of the released bowstring and cushioning or deadening the movement of the released bowstring. Such material may include various rubbers or elastomers as are well known to those skilled in the art.

In the preferred embodiment, as shown in FIGS. 1, 3, 4 and 5, piston 3 comprises a first end 20, a second end, 21, a central portion 14 and a pair of diametrically opposed grippers 12 formed integral with central portion 14 and ending from one end thereof. Central portion 14 is generally cylindrical in the disclosed embodiment. Central portion 14 further comprises a pair of diametrically opposed studs 13, discussed above, configured to matingly engage slots 11 formed in sleeve 2. In this manner, the movement of piston 3 within sleeve 2 may be advantageously controlled and limited by the movement of studs 13 within slots 11.

In one embodiment of bowstring sound dampener 1 of the present invention, the movement of piston 3 within sleeve 2 may be alternatively, or additionally, controlled and/or limited by permitting mounting rod 6 to be threadedly inserted into sleeve 2 such that the end of mounting rod 6 extends into the body of sleeve 2 sufficiently to interfere with the movement of piston 3, thereby creating a variable movement limiter (i.e., providing a stop past which piston 3 may not travel within sleeve 2).

In yet another embodiment of bowstring sound dampener 1 of the present invention, the movement of piston 3 within sleeve 2 may be alternatively, or additionally, controlled and/or limited by include a resilient stop member or bottoming pad (not shown) within sleeve 2. In this manner, the stop member would serve to limit the distance piston 3 may travel within sleeve 2 and, at the same time, would advantageously absorb some of the force of piston 3 upon impact of piston 3 with the stop member.

It also will be appreciated by those skilled in the art that an air pocket may be formed within sleeve 2 between the end of piston 3 and the first end 4 of sleeve 2. In this manner, the air pocket also can help dampen and control movement of piston 3 within sleeve 2.

As mentioned above, in the preferred embodiment of bowstring sound dampener 1 of the present invention, piston 3 comprises a pair of diametrically opposed grippers 12 formed at one end of central portion 14 of piston 3 and extending outwardly therefrom. Preferably, grippers 12 flare outwardly from piston 3 in a diametrically opposed configuration and the inner surfaces of grippers 12 are formed with a curved profile. In this manner, grippers 12 provide a wide target to receive the released bowstring and to guide the bowstring toward the intersection of grippers 12 where a groove 15 is formed.

In the preferred embodiment, groove 15 is formed at the intersection of grippers 12, groove 15 being configured to receive and retain the bowstring after the drawn bowstring is released. Preferably, groove 15 has a generally semi-circular profile when grippers 12 are open (or apart from one another) and a generally circular profile when grippers 12 are closed (or adjacent to one another). When grippers 12 are closed, groove 15 preferably has a diameter approximately equal to, or slightly less than, the diameter of the bowstring. In this manner, the bowstring may be firmly held within groove 15 after the bowstring is released.

In the preferred embodiment of bowstring sound dampener 1 of the present invention, grippers 12 are flexibly or pivotally mounted to central portion 14 of piston 3 such that grippers 12 may move inwardly, towards one another, when piston 3 enters the sleeve, grippers 12 being forced together by arms 10 as piston 3 travels into sleeve 2. Preferably, grippers 12 are biased outwardly, such that grippers 12 move outwardly, away from one other, when piston 3 exits sleeve 2.

Figure 2A:
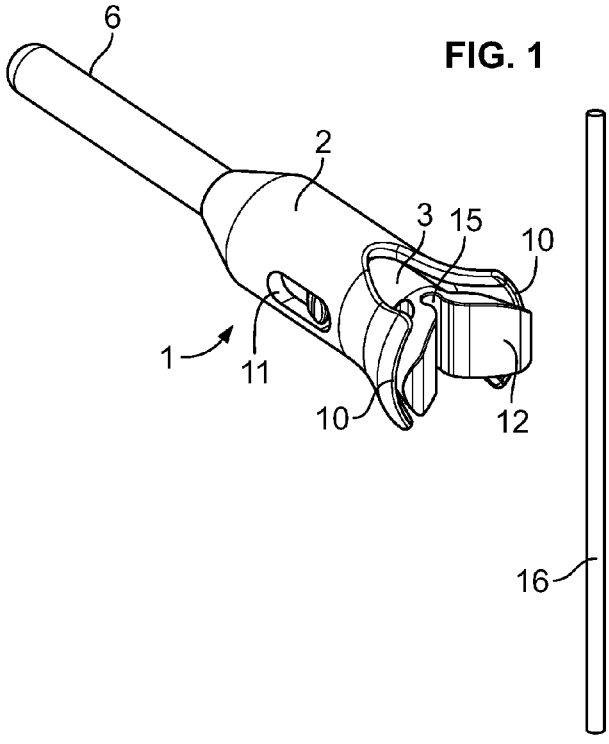
FIGS. 2A-2C are perspective views showing the operation of the bowstring sound dampener of FIG. 1.
Figure 2B:
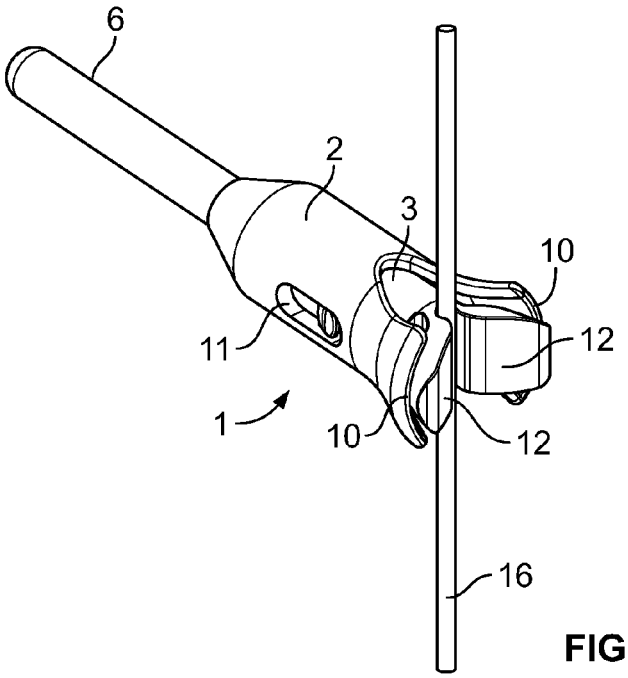
Figure 2C:
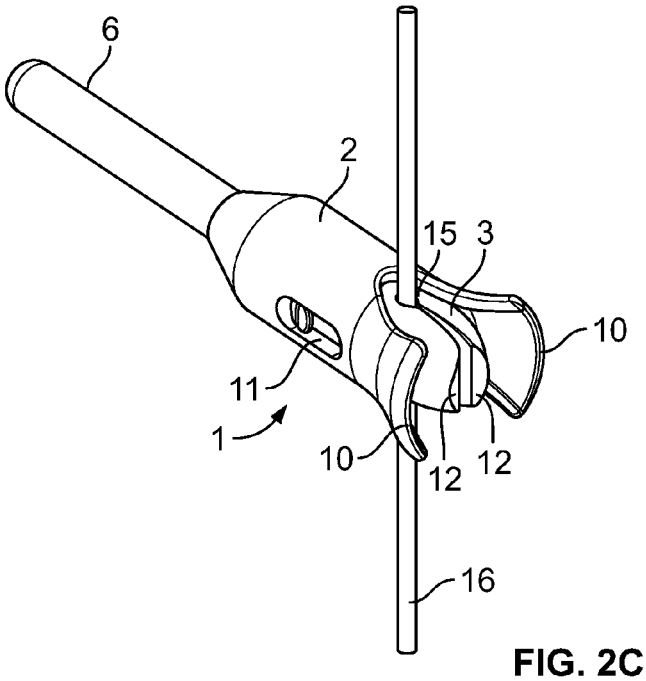
Figure 3:
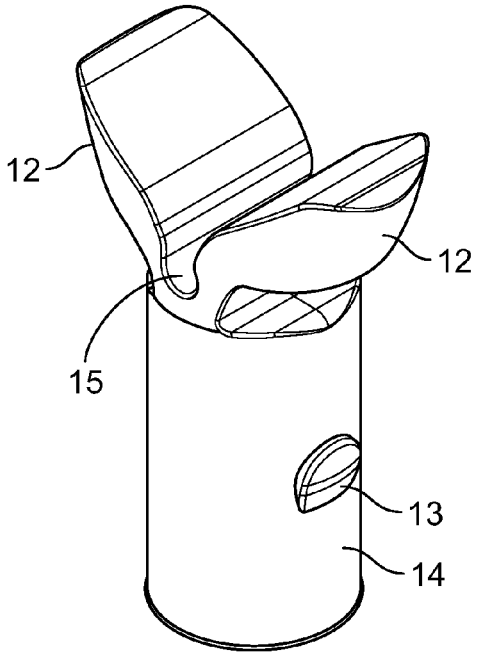
FIG. 3 is an enlarged perspective view of the piston of the bowstring sound dampener of FIG. 1.
Figure 4:
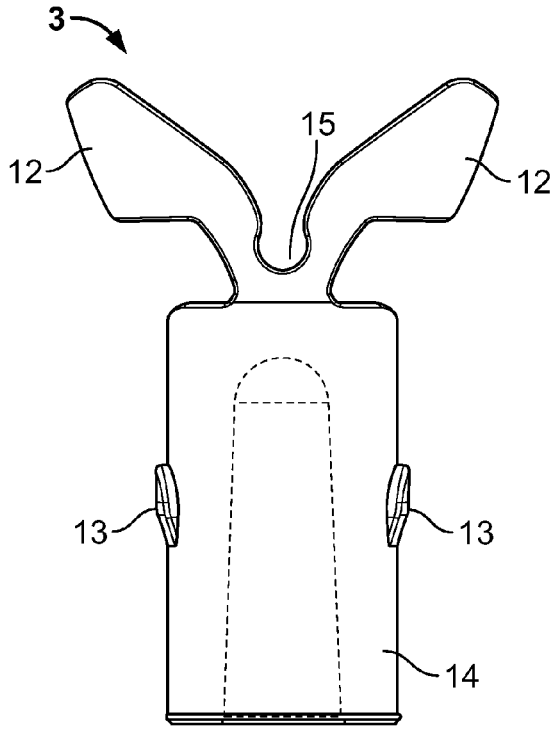
FIG. 4 is an enlarged front view of the piston of the bowstring sound dampener of FIG. 1.
Figure 5:
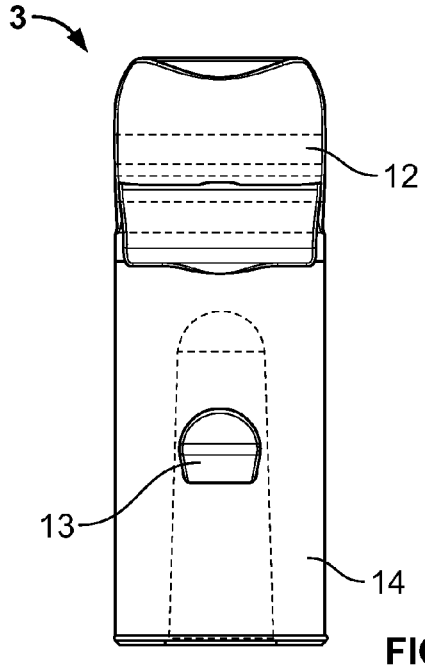
FIG. 5 is an enlarged side view of the piston of the bowstring sound dampener of FIG. 1.

In operation, as shown in FIGS. 2A-2C, bowstring sound dampener 1 of the present invention is positioned on the bow (not shown) using mounting rod 6. In the disclosed embodiment, bowstring sound damper 1 is positioned on the bow such that bowstring 16 is disposed within groove 15 of grippers 12, and grippers 12 are in a closed position, with piston 3 disposed within sleeve 2, when bowstring 16 is in the "dead" or "static" position (i.e., before bowstring 16 is drawn). In this manner, the position of bowstring 16 acts to bias piston 3 into sleeve 2 such that grippers 12 are maintained in closed position. FIG. 2C illustrates this position.

As shown in FIG. 2A, when bowstring 16 is drawn in preparation for a shot, bowstring 16 acts to pull piston 3 outwardly from sleeve 2 over a distance sufficient for grippers 12 to separate thereby releasing bowstring 16 from groove 15. Piston 3 preferably is prevented from fully withdrawing from sleeve 2 by the interaction of studs 13 and slots 11. However, in those embodiments of the bowstring sound dampener of the present invention that do not include studs 13 and slots 11, a slight frictional engagement between piston 3 and sleeve 2 can prevent piston 3 from fully withdrawing from sleeve 2 after bowstring 16 is released from groove 15.

As shown in FIG. 2B, once the drawn bowstring 16 is released, it travels between grippers 12 and is directed into groove 15. The force of bowstring 16 pushes piston 3 into sleeve 2 (as shown in FIG. 2B), causing grippers 12 to move toward one other and trapping bowstring 16 in groove 15 (as shown in FIG. 2C), thereby deadening, dampening and silencing bowstring 16. Because bowstring sound dampener 1 preferably is positioned on the bow such that grippers 12 are in a closed position, as discussed above, when bowstring 16 is in the "dead" or "static" position (i.e., before bowstring 16 is drawn), bowstring 16 acts to maintain grippers 12 in closed position, as shown in FIG. 2C.

It will be appreciated by those skilled in the art that bowstring sound dampener 1 of the present invention can be set off from the bow at different distances such that the operation of bowstring sound dampener 1 as shown in FIGS. 2A-2C can vary. For example, in some embodiments, bowstring sound dampener 1 can be positioned such that bowstring 16 is not disposed in, and fully gripped by, groove 15 when bowstring 16 is in the "dead" position (FIG. 2C), but, rather, bowstring 16 is disposed outside of groove 15 when bowstring 16 is in the "dead" position. Similarly, bowstring sound dampener 1 in some embodiments can be positioned such that bowstring 16 is disposed in, but not fully gripped by, groove 15 when bowstring 16 is in the "dead" position (FIG. 2B). All such variations in the positioning of bowstring sound dampener 1 are included within the scope of the instant disclosure.

All patents referred to herein, are hereby incorporated herein by reference, whether or not specifically done so within the text of this disclosure.

In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A bowstring sound dampener, the sound dampener comprising:

a sleeve, the sleeve comprising a first sleeve end, a second sleeve end, and a central sleeve portion disposed between the first sleeve end and the second sleeve end, the second sleeve end having a pair of arms, the arms flared outwardly from one another; and a piston, the piston comprising a first piston end, a central piston portion, and a second piston end, the first piston end matingly received inside the central sleeve portion, the second piston end having a pair of outwardly biased grippers extending therefrom, the grippers flared outwardly from one another;

wherein, in response to interaction by a bowstring, the grippers move inwardly towards one another when the piston moves in a first direction into the sleeve and outwardly away from one another when the piston moves in a second direction out of the sleeve, and wherein the grippers at least partially surround the bowstring when the piston moves in the first direction into the sleeve.

2. The bowstring sound dampener of claim 1 wherein the first sleeve end comprises a threaded bore configured to matingly receive a threaded mounting rod for mounting the bowstring sound dampener to a bow.

3. The bowstring sound dampener of claim 1 where in the first sleeve end is generally frustoconical.

4. The bowstring sound dampener of claim 1 wherein the central sleeve portion is generally cylindrical and hollow.

5. The bowstring sound dampener of claim 1 wherein the arms are diametrically opposed.

6. The bowstring sound dampener of claim 1 wherein the second sleeve end further comprises a pair of grooves configured to permit a bowstring to enter the second sleeve end.

7. The bowstring sound dampener of claim 6 wherein the grooves have a general V-shape.

8. The bowstring sound dampener of claim 6 wherein the grooves are diametrically opposed.

9. The bowstring sound dampener of claim 1 wherein the sleeve further comprises at least one slot formed in the central sleeve portion and the piston further comprises at least one stud configured to engage the at least one slot to control movement of the piston within the sleeve.

10. The bowstring sound dampener of claim 1 wherein the central piston portion is generally cylindrical.

11. The bowstring sound dampener of claim 1 wherein the grippers are diametrically opposed.

12. The bowstring sound dampener of claim 1 where the grippers are formed with curved profiles.

13. The bowstring sound dampener of claim 1 wherein the grippers are flared outwardly.

14. The bowstring sound dampener of claim 1 wherein the grippers further comprise a groove formed at an intersection of the grippers.

15. The bowstring sound dampener of claim 14 wherein the groove has a generally semi-circular profile when the grippers are open and a generally circular profile when the grippers are closed.

16. The bowstring sound dampener of claim 1 wherein the sound dampener is configured to be set off from a bow at a plurality of distances.

17. A bowstring sound dampener, the sound dampener comprising:

a sleeve, the sleeve comprising a first sleeve end configured to allow the bowstring sound dampener to be mounted to a bow, a second sleeve end having a pair of outwardly flared opposed arms, and a central sleeve portion disposed between the first sleeve end and the second sleeve end, the central sleeve portion having a pair of opposed slots formed therein;

a piston, the piston comprising a first piston end, the first piston end matingly received inside the central sleeve portion, a central piston portion, the central piston portion having a pair of opposed studs formed thereon and configured to matingly engage the pair of opposed slots in the central sleeve portion, and a second piston end, the second piston end having a pair of outwardly biased and outwardly flared grippers extending therefrom, wherein the grippers comprise a groove formed at an intersection of the grippers;

wherein, in response to interaction by a bowstring, the grippers move inwardly towards one another when the piston moves in a first direction into the sleeve and outwardly away from one another when the piston moves in a second direction out of the sleeve, and wherein the groove at least partially surrounds the bowstring when the piston moves in the first direction into the sleeve.

* * * * *